US007081006B2

(12) United States Patent
Lichtscheidl et al.

(10) Patent No.: US 7,081,006 B2
(45) Date of Patent: Jul. 25, 2006

(54) UTILITY CONNECTION STATION

(75) Inventors: Kristine E. Lichtscheidl, St. Francis, MN (US); Mark A. Schaffner, Maple Grove, MN (US); Thomas E. Kramer, Coon Rapids, MN (US); Fusu Thao, St. Paul, MN (US)

(73) Assignee: Fiskars Brands, Inc., Madison, WI (US)

( * ) Notice: Subject to any disclaimer, the term of this patent is extended or adjusted under 35 U.S.C. 154(b) by 209 days.

(21) Appl. No.: 10/773,567

(22) Filed: Feb. 6, 2004

(65) Prior Publication Data

US 2005/0176290 A1 Aug. 11, 2005

(51) Int. Cl.
*H01R 13/72* (2006.01)

(52) U.S. Cl. ..... 439/501; 439/527; 439/569; 439/535; 439/131

(58) Field of Classification Search ..... 439/535, 439/483, 501, 484, 534, 527, 131, 639, 650, 439/569; 174/53, 135; 248/51, 52, 917, 248/454, 455
See application file for complete search history.

(56) References Cited

U.S. PATENT DOCUMENTS 4,245,873 A * 1/1981 Markowitz ..... 439/32
4,911,652 A * 3/1990 Savoca et al. ..... 439/282
5,072,330 A * 12/1991 Fuqua ..... 361/681
5,122,069 A * 6/1992 Brownlie et al. ..... 439/131
5,277,620 A * 1/1994 Taylor ..... 439/490
5,364,289 A * 11/1994 Noguchi et al. ..... 439/501
6,004,138 A * 12/1999 Harbertson ..... 439/32
6,179,665 B1 * 1/2001 Rossman et al. ..... 439/654
6,229,584 B1 * 5/2001 Chuo et al. ..... 349/58
6,315,604 B1 * 11/2001 Lee ..... 439/535
6,483,028 B1 * 11/2002 DeBartolo et al. ..... 174/48
6,492,591 B1 * 12/2002 Metcalf ..... 174/53
6,568,946 B1 * 5/2003 Chou ..... 439/131
6,593,528 B1 * 7/2003 Franklin-Lees et al. ..... 174/58
6,603,656 B1 * 8/2003 Cho et al. ..... 361/683
6,672,088 B1 1/2004 Ueda
6,854,989 B1 2/2005 Milan

* cited by examiner

*Primary Examiner*—Gary Paumen
(74) *Attorney, Agent, or Firm*—Foley & Lardner LLP

(57) ABSTRACT

A utility connection station includes a body portion having a top, a bottom, opposite sides and a plurality of receptacles. A stand is coupled to the body portion and has a first arm and a second arm movable in opposite directions for activation of the stand between a stowed position and a deployed position. A first line management device is integrated with the stand and a second line management device is coupled to the body portion and are configured to hold one or more utility lines coupled to the receptacles. The body portion is supportable in a tower orientation when the stand is in the deployed position and the body portion is positionable in a low profile orientation when the stand is in the stowed position.

31 Claims, 8 Drawing Sheets

UTILITY CONNECTION STATION

FIELD

The present invention relates to a utility connection station. The present invention more specifically relates to a connection station for utilities configured for use in multiple orientations. The present invention more specifically relates to a connection station for utilities configured to manage utility lines.

BACKGROUND

It is well known to provide a connection device for utilities (such as power strips, power adapters, etc.). Such known connection devices typically have an incoming supply line (e.g. cord, cable, conductor, etc.) for utilities (such as electrical power, telecommunication signals, data signals, etc.) and one or more receptacles (e.g. outlets, jacks, connectors, etc.) for connecting other utility lines (e.g. electrical power cords, telecommunication lines, coaxial signal conductors, etc.) for distributing utilities from the connection device to other devices or locations.

The known connection devices for utilities typically have a box-like housing provided with receptacles and a power supply cord extending from an end of the housing. However, such known connection devices typically are not selectively configurable for use in different positions or applications. Further, such known connection devices typically do not guide or route utility lines extending therefrom in a convenient and organized manner.

Therefore, it would be desirable to provide a utility connection station having receptacles for interconnecting a plurality of utility lines. It would also be desirable to provide a utility connection station that is configurable for use in multiple positions or orientations. It would also be desirable to provide a utility connection station having a stand. It would be further desirable to provide a utility connection station having a stand that is selectively deployable for use. It would be further desirable to provide a utility connection station having a stand that is extendable and retractable. It would be further desirable to provide a utility connection station having a stand with a line management device that is selectively deployable. It would be further desirable to provide a utility connection station having multiple line management devices that are selectively deployable for use in routing, guiding or holding utility lines that are connected to the receptacles.

Accordingly, it would be desirable to provide a utility connection station having any one or more of these or other advantageous features.

SUMMARY

The present invention relates to a utility connection station and includes a body portion having a top, a bottom, opposite sides and a plurality of receptacles. A stand is coupled to the body portion and has a first arm and a second arm movable in opposite directions for activation of the stand between a stowed position and a deployed position. A first line management device is integrated with the stand and a second line management device is coupled to the body portion and is configured to hold one or more utility lines coupled to the receptacles. The body portion is supportable in a tower orientation when the stand is in the deployed position and the body portion is positionable in a low profile orientation when the stand is in the stowed position.

The present invention also relates to a connection device for utilities and includes a body having a base and a plurality of receptacles for utilities. A bracket selectively extendable and retractable from the base and is configured to guide one or more cords. A stand is located proximate the base and has a first portion and a second portion movable between an extended position and a retracted position. The body is configured for use in a first position when at least one of the first portion and second portion of the stand are in the extended position. The body is configured for use in a second position when at least one of the first portion and the second portion are in the retracted position.

The present invention further relates to a connection device for utilities having receptacles configured to interconnect with utility lines. The connection device includes an elongated body for housing the receptacles, and a line management device configured to guide the utility lines that are connected to the receptacles. A stand is provided that is movable in relation to the body between a deployed position to support the body in an upright orientation and a stowed position to permit the body to be placed in a flat orientation on a worksurface.

The present invention further related to a utilities connection device having a body with receptacles for interfacing with utility lines and includes a support structure movable between a first position to support the body in a generally vertical orientation and a second position configured to permit placement of a side of the body on a worksurface. A utility line holder is coupled to the body and configured to restrain the utility lines in a desired position.

DETAILED DESCRIPTION OF THE PREFERRED AND OTHER EXEMPLARY EMBODIMENTS

Figure 1:
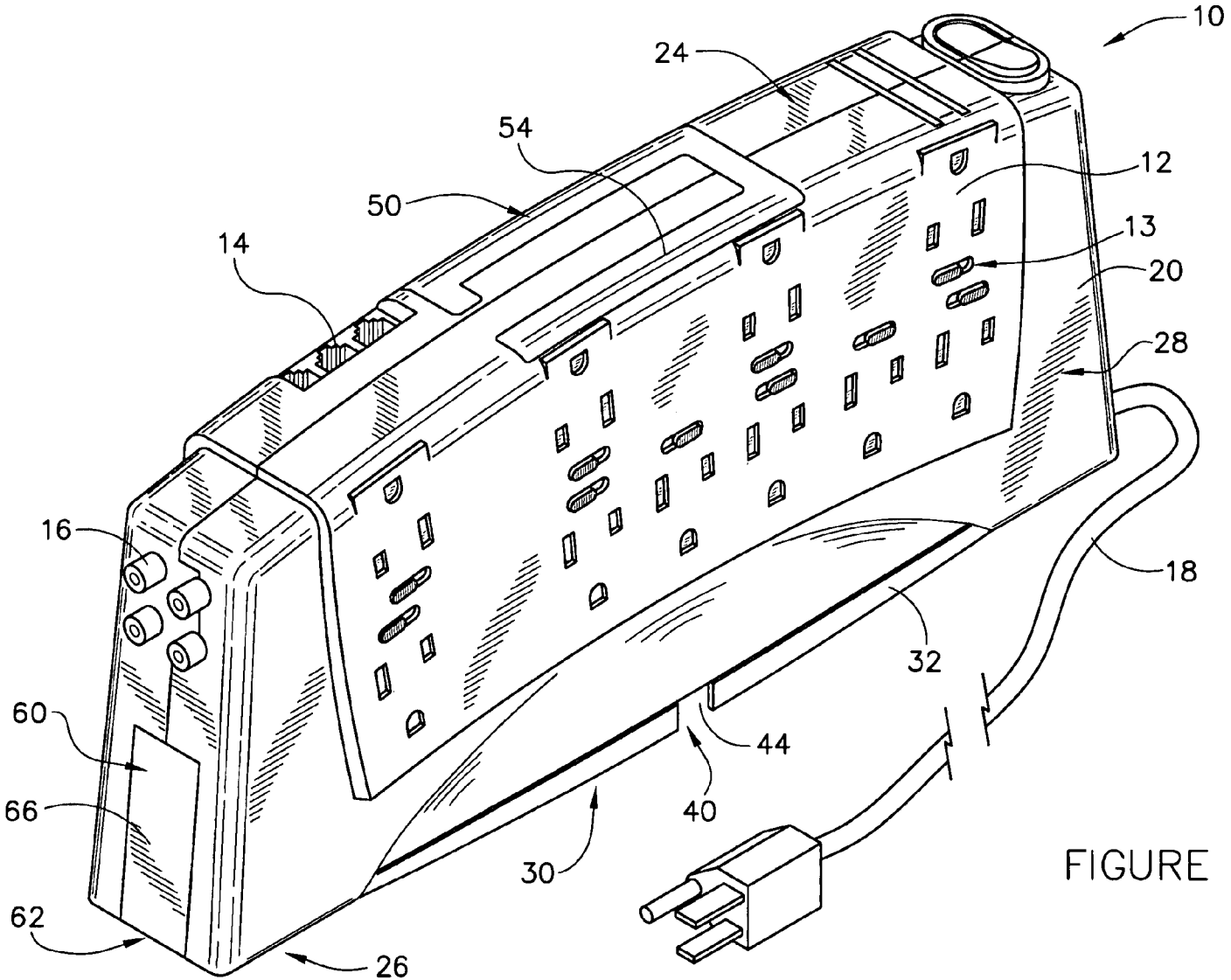
FIG. 1 is a perspective view of a utility connection station according to an exemplary embodiment.
Figure 2:
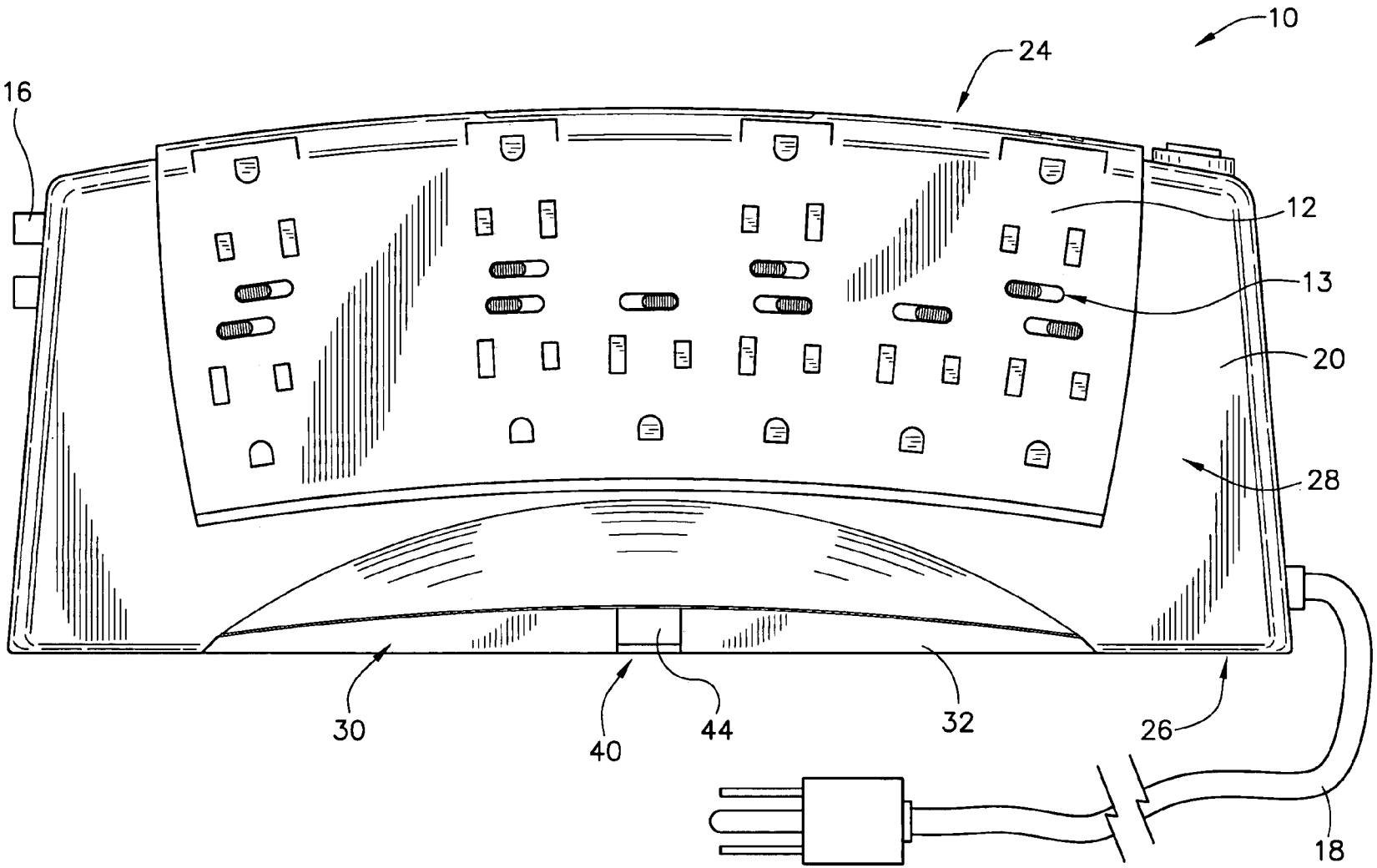
FIG. 2 is a front elevation view of the utility connection station of FIG. 1 according to an exemplary embodiment.
Figure 3:
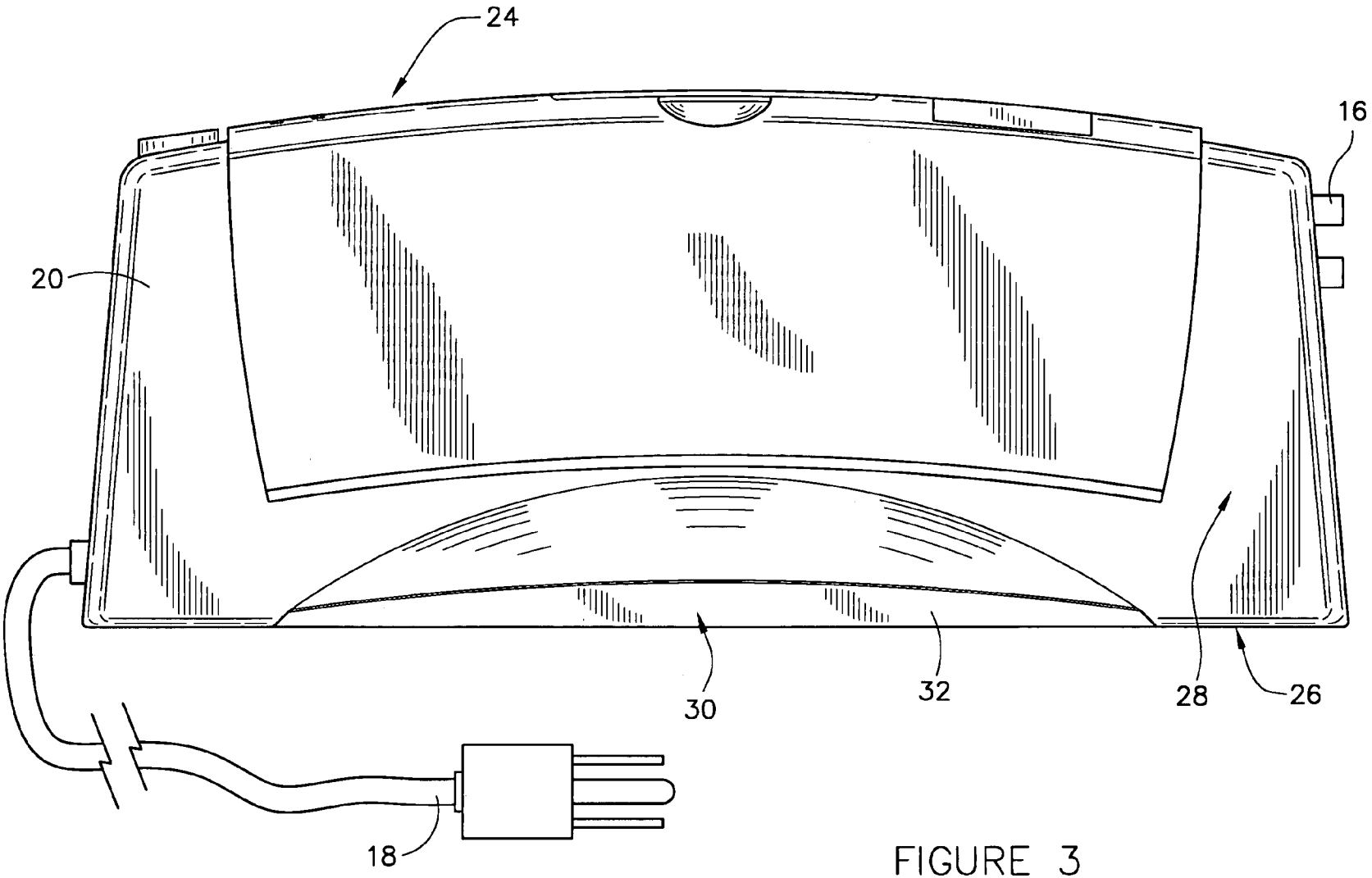
FIG. 3 is a back elevation view of the utility connection station of FIG. 1 according to an exemplary embodiment.

Referring to the FIGURES, a utility connection station 10 (e.g. utilities connection device, connection device for utilities, utilities adapter device, utilities connection strip, etc.) is shown according to an exemplary embodiment for use in connecting and protecting various devices. Utility connection station 10 is shown schematically to include a body portion 20 having a plurality of receptacles provided therein, a stand device 30, line management devices 40, 50, and an auxiliary receptacle device 60.

Referring to the FIGURES, body portion 20 is shown schematically according to an exemplary embodiment to include a generally rectangular housing 22 with rounded corners, a contoured top 24, a generally flat base or bottom 26, and generally flat sides 28. The body portion may be made of any suitable material, such as acrylonitrile butiadene styrene (ABS) plastic formed in a molding operation or other suitable operation, and configured for holding hardware associated with the receptacles. According to an alternative embodiment, the body portion may have any suitable shape and contour, and may be made of other materials, such as those having other lightweight and electrical insulating properties.

Referring to the FIGURES, body portion 20 includes a stand device 30 (e.g. frame, support structure, etc.). Stand device 30 is configured to be deployed (e.g. extended to a use position, etc.) when utility connection station 10 is positioned for use in a generally upright orientation (e.g. vertical, free standing, tower, etc.—as shown schematically in FIGS. 1 and 9) with bottom 26 of body portion 20 supported by a surface (such as a floor, worksurface, etc.). Such a generally upright orientation is also intended to be useful in permitting the utility connection station to be placed against a wall (i.e. to "hug" the wall). When stand device 30 is not deployed (e.g. retracted to a stowed position within the body portion), utilities connection station 10 may be positioned in a generally flat orientation (e.g. horizontal, etc.—as shown schematically in FIG. 8) with a side 28 supported by a surface (such as a floor worksurface, etc.). The worksurface may be any suitable surface where use of a utility connection device may be desirable, such as a desktop, tabletop, countertop, shelf, storage cabinet, floor, article of furniture, etc.).

Figure 4A:
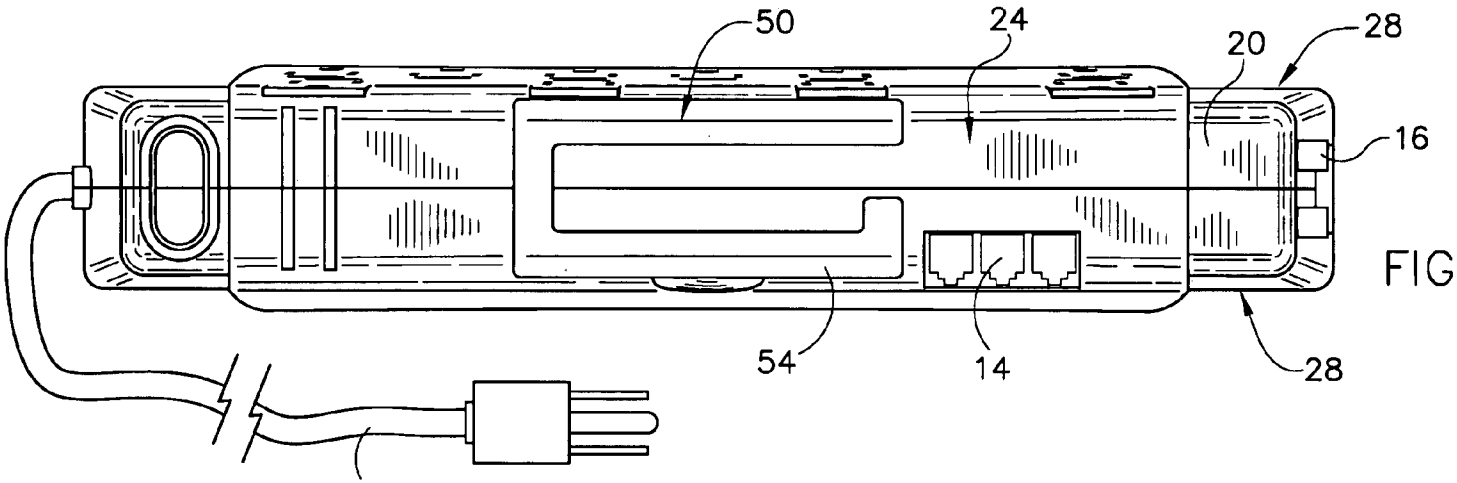
FIG. 4A is a top view of the utility connection station of FIG. 1 according to an exemplary embodiment.
Figure 4B:
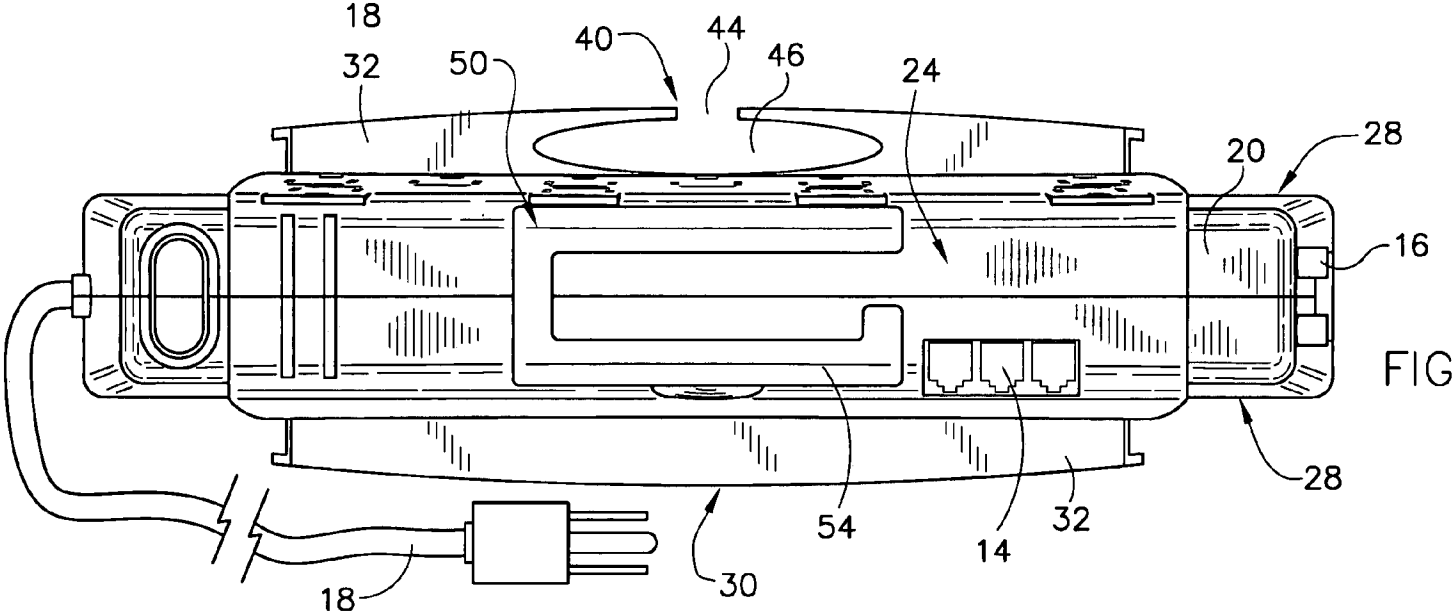
FIG. 4B is a top view of the utility connection station of FIG. 1 according to an exemplary embodiment.
Figure 5A:
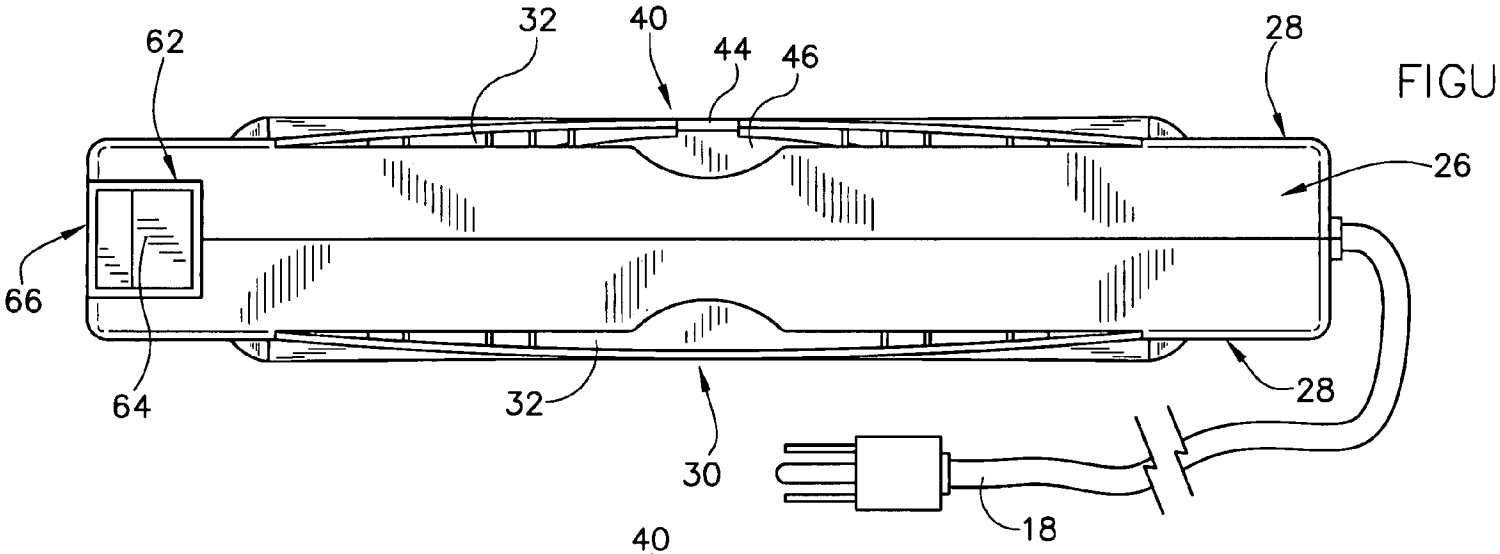
FIG. 5A is a bottom view of the utility connection station of FIG. 1 in a first configuration according to an exemplary embodiment.
Figure 5B:
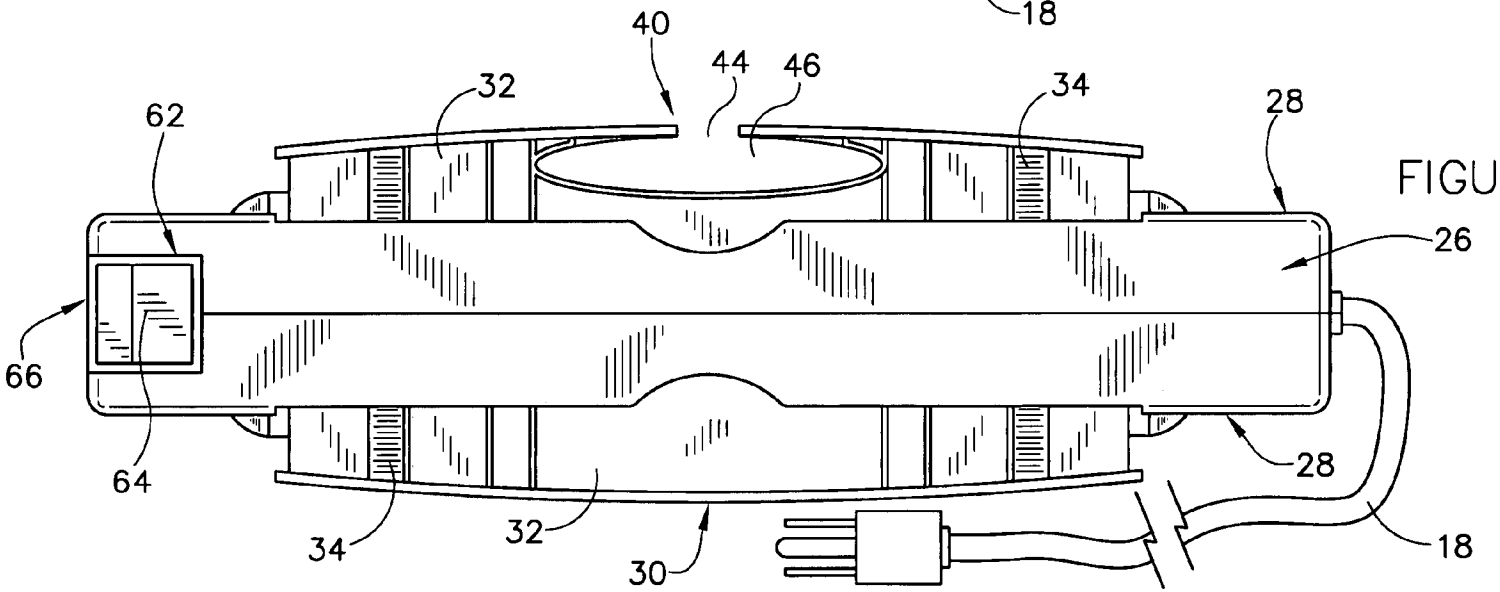
FIG. 5B is a bottom view of the utility connection station of FIG. 1 in a second configuration according to an exemplary embodiment.
Figure 7:
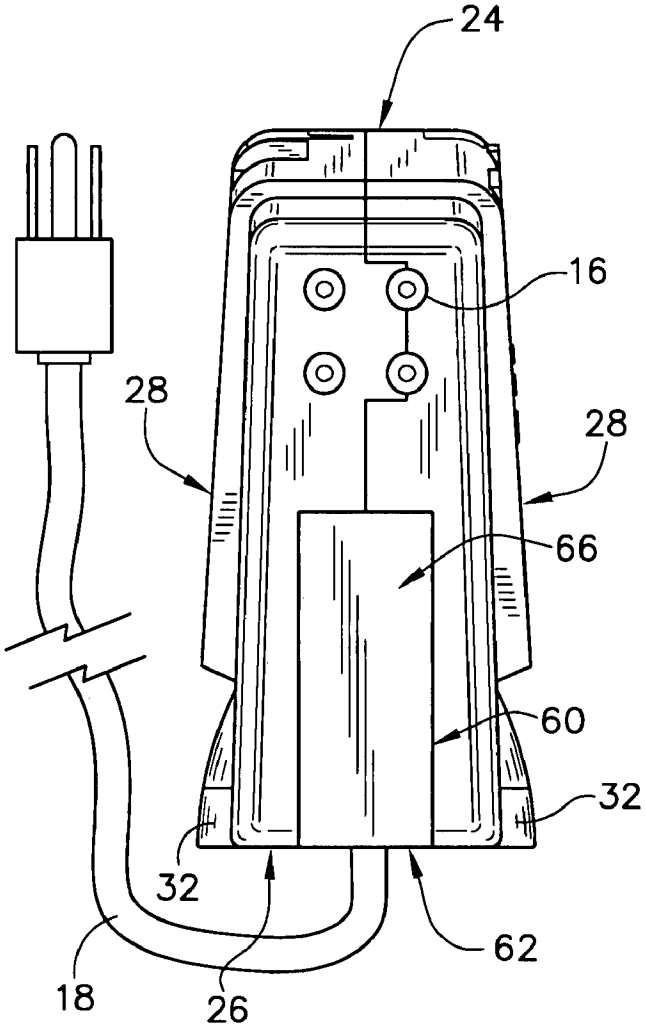
FIG. 7 is an opposite side elevation view of the utility connection station of FIG. 1 according to an exemplary embodiment.
Figure 6:
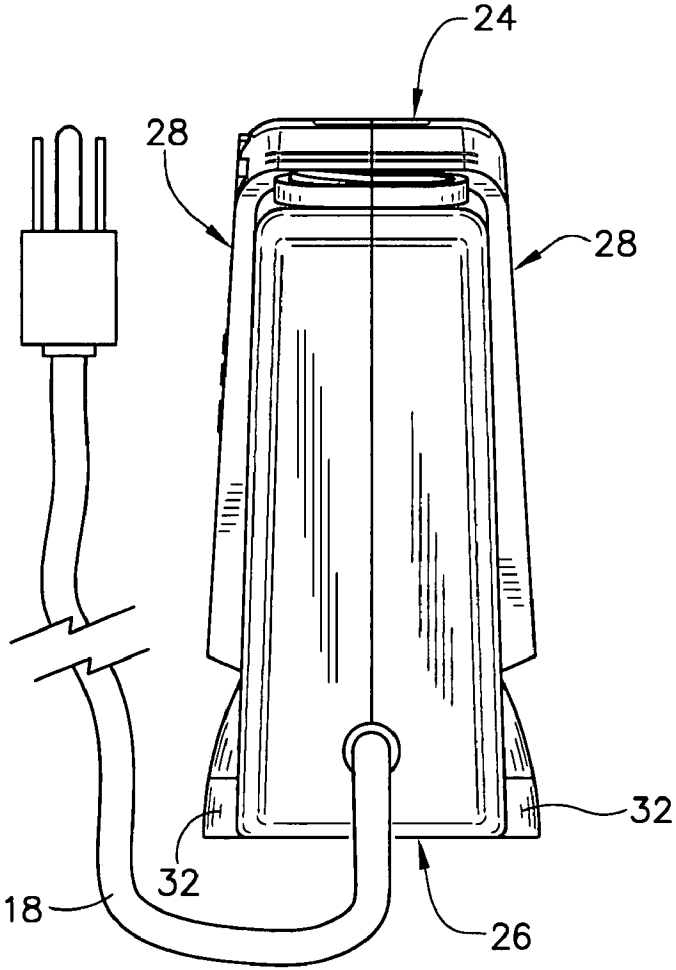
FIG. 6 is a side elevation view of the utility connection station of FIG. 1 according to an exemplary embodiment.

Stand device 30 is shown schematically to include selectively deployable arm members 32 (e.g. brackets, wings, etc.) that are configured to be stowed within an opening (e.g. recess, pocket, etc.) within body portion 20 adjacent bottom 26 (see FIGS. 4A and 5A). Arm members 32 are configured to be extended outwardly from body portion 20 for deployment (see FIGS. 4B and 5B) to provide support and stability to body portion 20 when the utility connection station is positioned in a generally upright orientation. Arm members 32 are shown as horizontally slidable in opposing directions and may be configured for movement of a single arm or movement both arms simultaneously. Arm members 32 are shown schematically with positioners 34 (e.g. detents, coating ridges, etc.) for providing a frictional interaction with body portion 20 so that the position of arm members 32 may be fixed relative to body portion 20. The positioners are operable to adjustably set the position of one or both arms relative to the body portion. According to an alternative embodiment, the stand device may include arms that are movable in a pivoting, swinging, or rotational manner. According to another alternative embodiment, the stand device may be configured for partial or complete removal or separation from the body portion. According to a further alternative embodiment, the arm members may include activation assistance, such as a push—push type mechanism, or other spring assisted device.

Referring to the FIGURES, utility connection station 10 is shown to include line management devices 40, 50 (e.g. cord management devices, cable management devices, cord catchers, etc.) intended for use in managing the position and routing of utility lines (e.g. lines, cords, cables, conductors, etc.) that are connected to the receptacles, according to an exemplary embodiment. Referring to FIGS. 4B, 5B, 8 and 9, a first line management device 40 is shown schematically as integrated into arm 32 of stand device 30. Line management device 40 includes a holder 42 (e.g. retainer, etc.) having an opening shown as a passage 44 and a slot 46 (shown as having a generally oval shape) within which utility lines may be routed when arm 32 is extended from body portion 20 (as shown schematically in FIG. 8). Line management device 40 is shown to be selectively deployable by moving (e.g. sliding) arm 32 outwardly from body portion 20 an amount sufficient for use in holding the utility lines in a desired routing location, such as when utility connection station 10 is used in a generally horizontal orientation. Line management device 40 may be integrated into one or both arms 32 of stand device 30.

Figure 8:
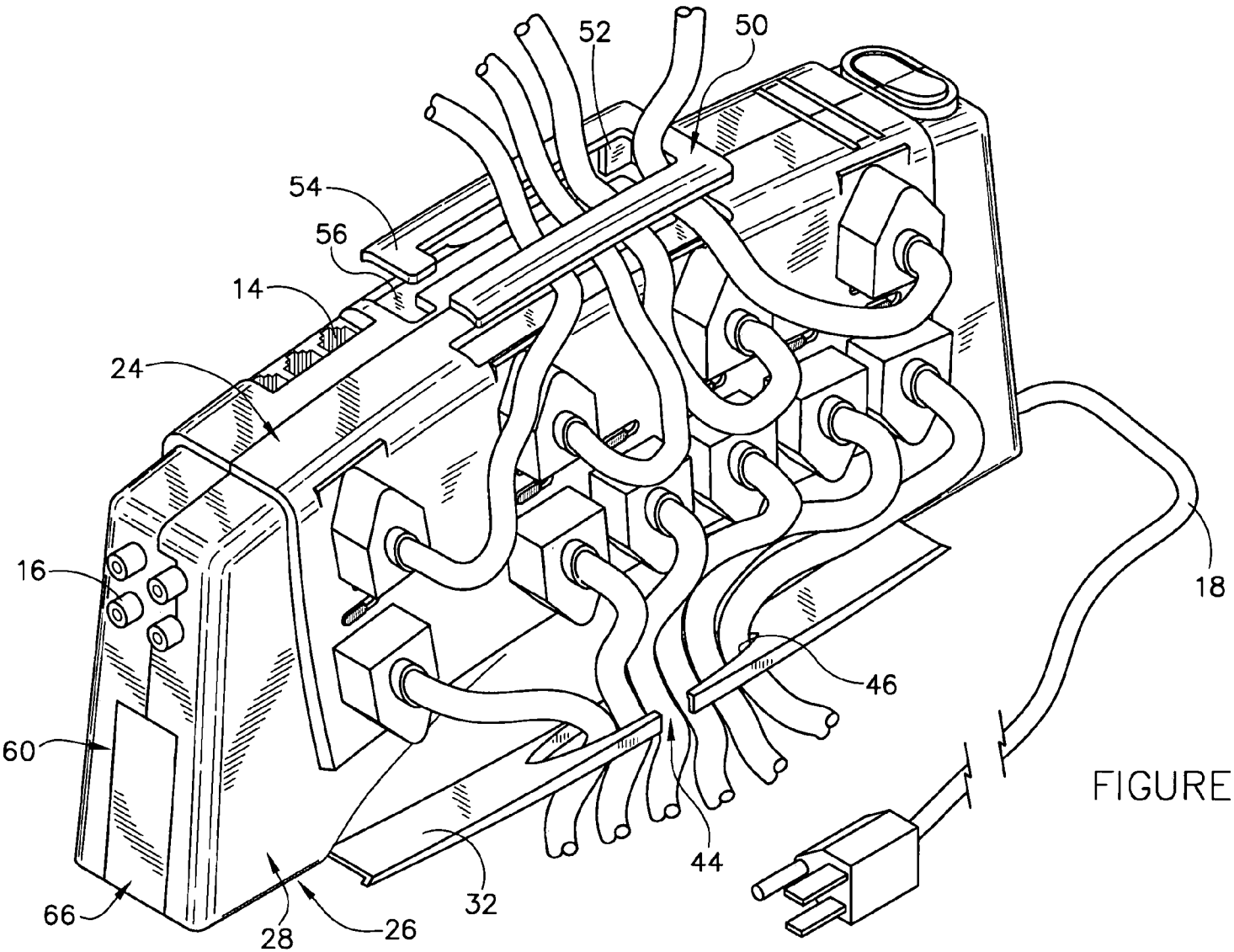
FIG. 8 is a perspective view of the utility connection station of FIG. 1 arranged in one orientation according to an exemplary embodiment.
Figure 9:
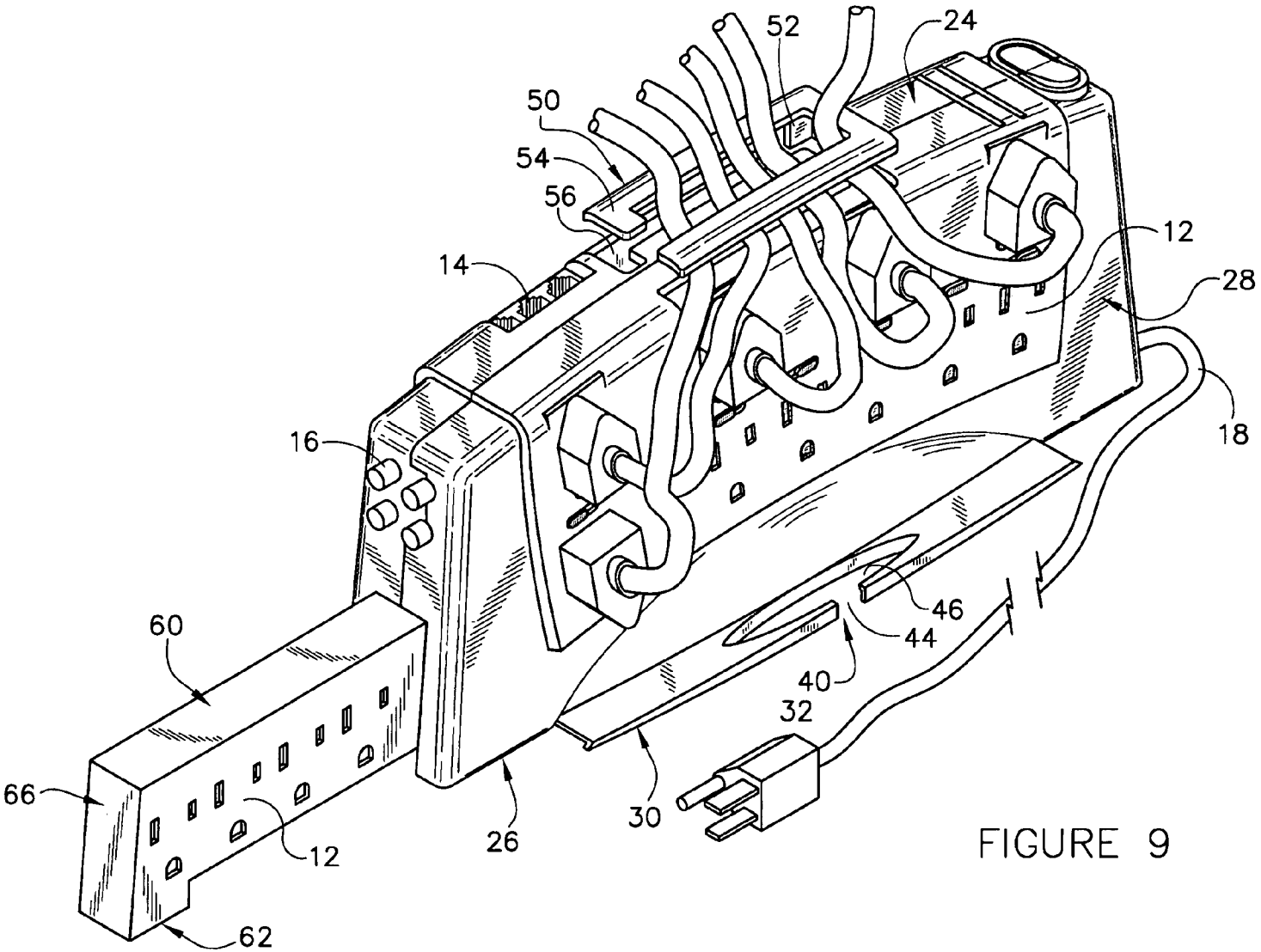
FIG. 9 is a perspective view of the utility connection station of FIG. 1 arranged in another orientation according to an exemplary embodiment.

Referring to FIGS. 1, 4A, 4B, 8 and 9, a second line management device 50 is shown according to an exemplary embodiment. Line management device 50 includes a frame having legs 52 (e.g. posts, columns, etc.) extending from a holder 54. Legs 52 are shown configured to be slidably extensible from top 24 of body portion 20 so that holder 54 is movable between a stowed position within a suitable recess 56 on top 24, and a deployed position extending outwardly from top 24. The location of line management device 50 on top 24 is intended to permit deployment and use of line management device 50 when utility connection station 10 is used in either a generally upright position (as shown in FIG. 9) or a generally flat position (as shown in FIG. 8).

Referring further to FIGS. 1, 8 and 9, holder 54 is shown having a structure (e.g. bracket, etc.) configured to hold utility lines in a desired routing location. According to a preferred embodiment, holder 54 has a structure in the shape of a generally elongated "U" or a "C". Holder 54 may also be configured for use as a handle, such as for carrying or transporting the utility connection station, or may be configured as a hook, such as for suspending the utility connection station in a work area. The legs are provided with positioners (such as detents, etc.—not shown) configured to create a frictional interface or the like with body portion 20 so that legs 52, when moved, tend to stay in one of the stowed position and the deployed position. According to an alternative embodiment, the second line management device may be provided with assisted actuation. For example, the second line management device may include a push—push type actuating mechanism or other type of spring-assisted device for extending and/or retracting the legs. According to another alternative embodiment, the second line management device may be located at any suitable location on the body portion, and the holder may have any suitable shape or profile for holding utility lines.

According to other alternative embodiments the line management devices may include hooks, retainers, or other structure for capturing and holding utility lines that are connected to the receptacles, and may be provided with a biasing device (such as a spring, etc.) for providing a force sufficient to retain (e.g. clamp, etc.) the utility lines in a desired location.

Referring to FIGS. 1, 2, 8 and 9, a plurality of receptacles are provided in the body portion according to an exemplary embodiment. The receptacles are shown schematically, for example, as electrical receptacles 12, telecommunication jacks 14, and coaxial cable connectors 16 of a conventional type, adapted for interconnection with utility lines having suitable connectors of a corresponding conventional type. The receptacles may be configured for providing a supply of a utility (e.g. electrical power, telecommunication signal, voice/data signal, fiber-optic signal, infrared signal, etc.) from a source (shown schematically as electrical power cord 18 according to one embodiment) in a conventional manner. Certain receptacles may also be configured for adapting (e.g. joining, coupling, splitting, distributing, etc.) utilities that are provided at other receptacles (such an "inlet" receptacle and an "outlet" receptacle, as are generally known in conventional adapters). The receptacles may be provided with covers (shown schematically as sliding covers 13 on electrical receptacles 12) for shielding exposure to the utilities. The receptacles may also be provided with protective features (such as surge protection, etc.), a master on-off switch, and a grounded power cord, as are generally available in conventional utilities adapters.

Receptacles may also be provided on an auxiliary receptacle device (shown schematically as an extensible receptacle strip member 60 or "extender bar" having, for example, electrical receptacles therein) that is selectively deployable between a storage position (as shown schematically inside body portion 20 in FIG. 1) and a use position, at least partially external to body portion 20 (as shown schematically in FIG. 9). Receptacle strip member 60 is configured to be slidably extensible within a recess (e.g. pocket, channel, etc.) formed within body portion 20 so that it may be extended when the availability of additional receptacles is desired and retracted when additional receptacles are not desired. Receptacle strip member 60 includes a foot portion 62 that provides a gripping location 64 (e.g. "handle" as shown schematically in FIG. 5A) for use in grasping and deploying receptacle strip member 60 and provides a support for a free end 66 of receptacle strip member 60 when deployed to the use position.

According to any preferred embodiment, a utility connection station is provided that includes a selectively deployable stand member that is configured for positioning the body portion in a generally upright orientation, such as for use as a tower, or a generally flat orientation, such as for use in a "low-profile" type application. Line management devices are provided and are selectively deployable from the body portion for use in routing and holding the utility lines that are routed adjacent the body portion for connection to the receptacles.

According to any alternative embodiment, the utility connection station may be equipped with suitable hardware of a conventional type for receiving, transmitting, adapting, distributing or splitting utilities (such as electrical power, telecommunication signals, voice/data signals, etc.). The utility connection station may also be equipped with suitable protection devices of a conventional type (such as power surge arrestors, on-off switches, overload protection, ground fault interruption, indicator lights, EMI/RFI filters, "always-on" receptacles that are independent of on-off switches, etc.).

It is important to note that the construction and arrangement of the elements of the utility connection station as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the line management devices may be reconfigured, actuation-assisted, or otherwise varied, or the length or width of the structures and the location and type of the receptacles or other elements of the utility connection station may be varied. It should be noted that the elements and/or assemblies of the utility connection station may be constructed from any of a wide variety of materials that provide sufficient strength, durability and electrical resistance, in any of a wide variety of colors, textures, shapes and combinations. It should also be noted that the utility connection station may be configured in a suitable shape (e.g. rectangular, triangular, oval, etc.) and used in association with a wide variety stand configurations to support use in any of a wide variety of orientations and applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A utility connection station, comprising:

a body portion having a top, a bottom, opposite sides and a plurality of receptacles;

a stand coupled to the body portion and having a first arm and a second arm movable in opposite directions for activation of the stand between a stowed position and a deployed position;

a first line management device integrated with the stand and a second line management device coupled to the body portion and configured to hold one or more utility lines when coupled to the receptacles;

wherein the body portion is supportable in an tower orientation when the stand is in the deployed position and the body portion is positionable in a low-profile orientation when the stand is in the stowed position.

2. The utility connection station of claim 1 wherein the second line management device is selectively extendable and retractable from the top of the body portion.

3. The utility connection station of claim 1 wherein at least one of the line management devices further comprises activation assistance.

4. The utility connection station of claim 1 wherein at least one of the first arm and the second arm are activation assisted.

5. The utility connection station of claim 1 wherein the second line management device further comprises a handle.

6. The utility connection station of claim 1 wherein the second line management device further comprises a hook member configured to suspend the body portion in a work area.

7. The utility connection station of claim 1 wherein the first arm and the second arm further comprise a frictional interface with the body portion configured for positioning the first arm and the second arm in a desired location.

8. A connection device for utilities, comprising:

a body having a base and a plurality of receptacles for utilities;

a bracket selectively extendable and retractable from the base and configured to guide one or more cords; and a stand proximate the base and having a first portion and a second portion movable between an extended position and a retracted position so that the body is configured for use in a first position when at least one of the first portion and second portion of the stand are in the extended position and the body is configured for use in a second position when at least one of the first portion and the second portion are in the retracted position.

9. The connection device for utilities of claim 8 wherein the bracket comprises a holder having a U shape.

10. The connection device for utilities of claim 8 further comprising an extension member having a plurality of receptacles and movable between a deployed position for use and a stowed position for storage.

11. The connection device for utilities of claim 8 wherein the utilities are at least one of electrical power, telecommunication signals, voice signals and data signals.

12. The connection device for utilities of claim 8 wherein at least one of the first portion and the second portion further comprise a cord management device configured to guide cords that interface with the receptacles.

13. The connection device for utilities of claim 8 wherein the first position is a tower position and the stand is configured to support the base on a worksurface.

14. The connection device for utilities of claim 8 wherein the second position is a flat position where a side of the body is configured for placement on a worksurface.

15. In a connection device for utilities having a plurality of receptacles configured to interconnect with a plurality of utility lines, the improvement comprising:

a body for housing the receptacles;

a line management device configured to guide the utility lines connected to the receptacles;

a stand movable in relation to the body between a deployed position to support the body in a first orientation and a stowed position to permit the body to be placed in a second orientation; and a receptacle strip movable between a first position internal to the body and a second position at least partially external to the body.

16. The connection device for utilities of claim 15 wherein the line management device further comprises a first line management device and a second line management device.

17. The connection device for utilities of claim 16 wherein the first line management device comprises an opening in the stand.

18. The connection device for utilities of claim 16 wherein the second line management device comprises a U-shaped member that is extendable and retractable in relation to the body.

19. The connection device for utilities of claim 15 wherein the stand further comprises a first arm and a second arm that are selectively extendable and retractable from an end of the body.

20. The connection device for utilities of claim 15 wherein the receptacle strip is movable in a telescoping manner.

21. The connection device for utilities of claim 20 wherein the receptacle strip comprises a foot configured to support a free end of the receptacle strip when the receptacle strip is moved to the deployed position.

22. The connection device for utilities of claim 15 wherein the utilities are at least one of electrical power, a telecommunication signal, a voice signal, a data signal, a fiber-optic signal and an infrared signal.

23. In an utilities connection device having a body with a plurality of receptacles for interfacing with a plurality of utility lines, the improvement comprising:

a support structure at least partially stowable within the body and movable between a first position to support the body in a first orientation and a second position configured to permit placement of the body in a second orientation; and a utility line holder coupled to at least one of the support structure and the body and configured to restrain the utility lines in a desired position.

24. The utilities connection device of claim 23 wherein the utilities are at least one of electrical power, a telecommunication signal; a voice signal, a data signal, a fiber-optic signal and an infrared signal.

25. The utilities connection device of claim 23 wherein the receptacles are at least one of electrical outlets, coaxial cable connectors, and telecommunication jacks.

26. The utilities connection device of claim 23 wherein the support structure comprises a first portion and a second portion movable between a stored position substantially within the body and a use position extending at least partially from the body.

27. The utilities connection device of claim 26 wherein the first portion and second portion are slidably movable in opposite directions.

28. The utilities connection device of claim 26 wherein the utility line holder comprises an opening in at least one of the first portion and the second portion.

29. The utilities connection device of claim 23 wherein the utility line holder comprises a frame member extendable from the body between a stored position and a use position.

30. The utilities connection device of claim 29 wherein the frame member comprises a generally U shaped member configured to receive one or more of the utility lines.

31. The utilities connection device of claim 26 wherein the first portion and the second portion further include an positioning device configured for positioning the first portion and the second portion in a plurality of positions.

* * * * *